United States Patent [19]

Fiore

[11] Patent Number: 4,665,573

[45] Date of Patent: May 19, 1987

[54] CONTOURED BODY SUPPORT STRUCTURE

[76] Inventor: Timothy J. Fiore, 4448 Charter Point Blvd., Jacksonville, Fla. 32211

[21] Appl. No.: 734,835

[22] Filed: May 16, 1985

[51] Int. Cl.[4] ..... A47C 27/00

[52] U.S. Cl. ..... 5/448; 5/464; 5/465

[58] Field of Search ..... 5/431, 434, 436, 446, 5/447, 464, 465, 443, 448; 128/20

[56] References Cited

U.S. PATENT DOCUMENTS

| | | | |
|---|---|---|---|
| 1,045,228 | 11/1912 | Weltmer | 5/436 |
| 2,373,421 | 4/1945 | Schenker | 5/446 |
| 2,391,746 | 12/1945 | Schenker | 5/238 |
| 3,639,927 | 2/1972 | Munch | 5/465 |
| 3,877,093 | 4/1975 | Gershbein | 5/465 |
| 3,885,258 | 5/1975 | Regan | 5/464 |
| 4,206,524 | 6/1980 | Cook | 5/468 |
| 4,207,635 | 6/1980 | Leroy | 5/446 |
| 4,335,495 | 8/1985 | Oldfield | 5/436 |

FOREIGN PATENT DOCUMENTS

| | | | |
|---|---|---|---|
| 1499275 | 9/1967 | France | 128/70 |
| 1031814 | 6/1966 | United Kingdom | 5/436 |

*Primary Examiner*—Gary L. Smith
*Assistant Examiner*—Michael F. Trettel
*Attorney, Agent, or Firm*—Arthur G. Yeager

[57] ABSTRACT

A structure having an upper surface contoured to maintain the spine of a person lying horizontal on the mattress in the proper curvature regardless of whether the person is lying in the supine, prone, or side position; the upper surface having a convex shape in each of the lumbar and knee regions and having a concave depression in the sacral region, with reduced tapering end portions from the lumbar and knee regions to the ends of the support.

20 Claims, 11 Drawing Figures

FIG. 1
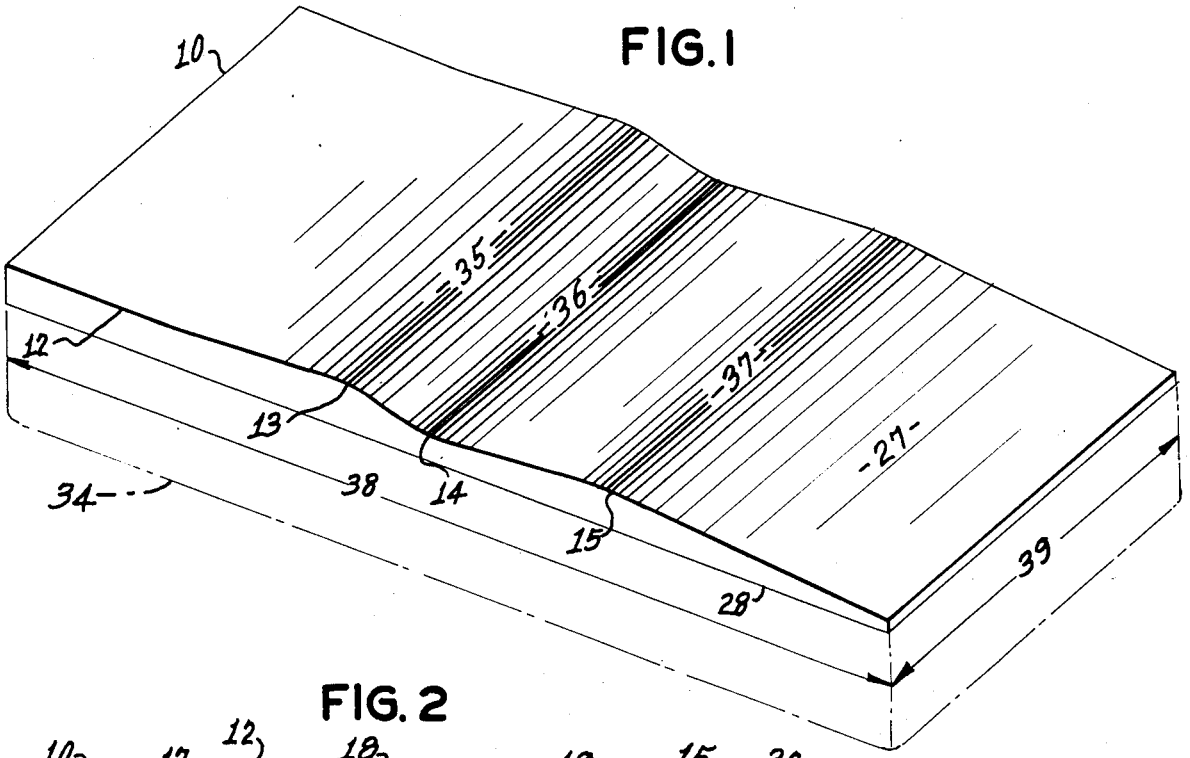
FIG. 2
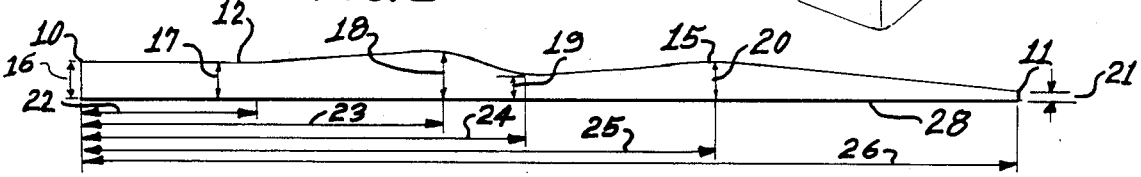
FIG. 3
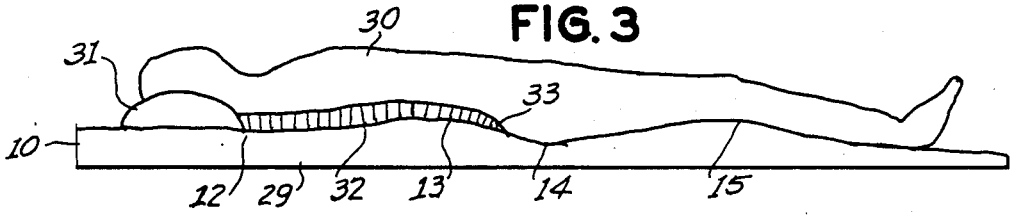
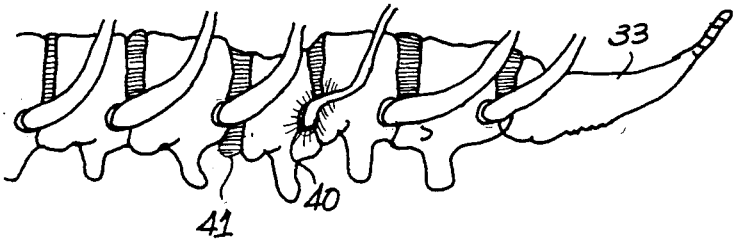
FIG. 3A
FIG. 3B
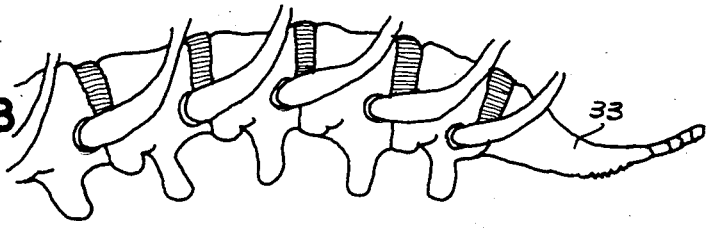

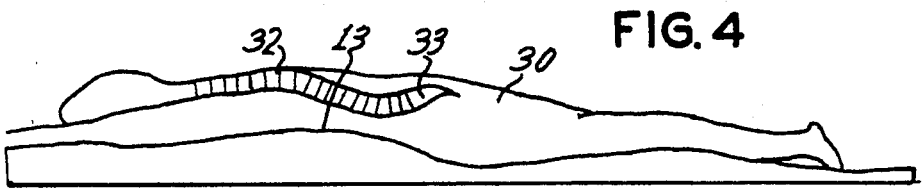
FIG. 4
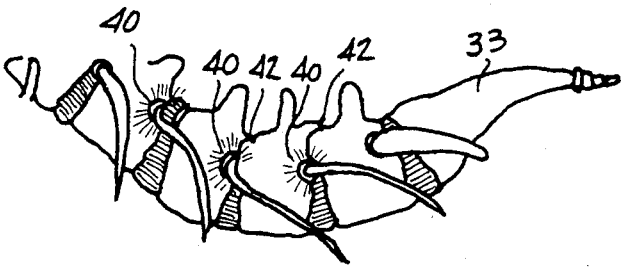
FIG. 4A
FIG. 4B
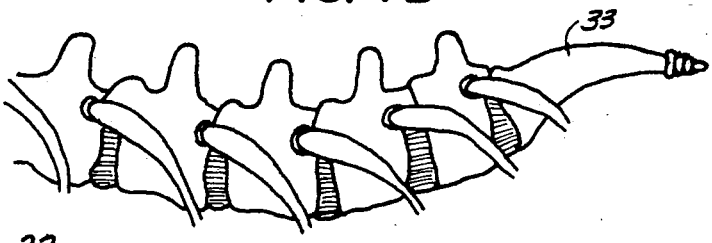
FIG. 5
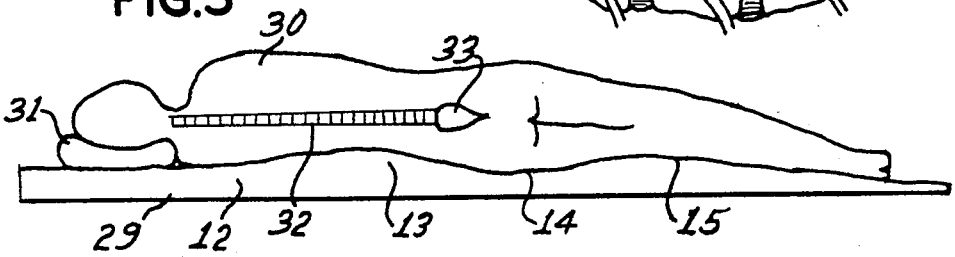
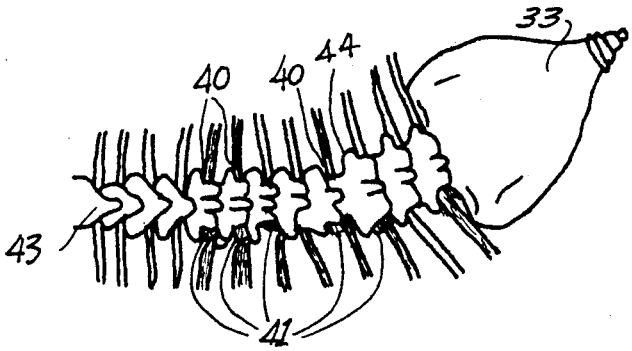
FIG. 5A
FIG. 5B
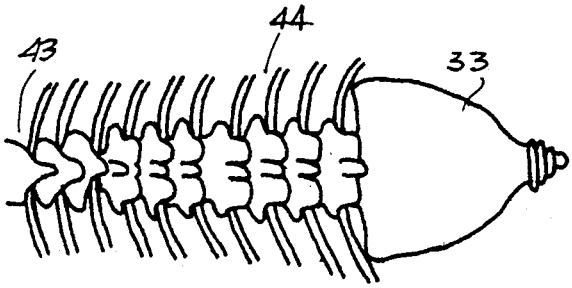

CONTOURED BODY SUPPORT STRUCTURE

BACKGROUND OF THE INVENTION

The human spine with its many vertebrae separated from each other by resilient discs and having nerves branching out from openings between adjacent vertebrae is the source of many of mankinds aches and pains. In order to prevent many back pains it is important to maintain the spine in its natural curvature during periods of rest, principally while sleeping. The conventional flat top mattress supports only the convex parts of the body that protrude outwardly, such as the heels, buttocks, thoracic spine, shoulders, and head. The concave portions of the body such as the neck, small of the back, back of the knees, etc. are not supported unless the mattress is extremely soft and this can also cause problems. Such unsupported portions of the body are found regardless of whether the sleeper lies on his back (supine), on his stomach (prone), or on his side.

Many prior art workers have tried to design a mattress that will support more of the body than those portions resting on a flat top mattress. None of these provides full support for all sleeping positions.

In U.S. Pat. No. 2,373,421 to Schenker there is disclosed an innerspring mattress which has contours that are overly accentuated in the thoracic and lumbar areas and does nothing for the knee area. More specifically, Schenker provides excessive lumbar support when the person is in the side posture; the alleged hamstring relaxer is not sufficiently elevated to effect a proper bend in the knee, i.e., one which effectively relaxes the muscles beneath the knee; it appears to provide a hyperlordotic lumbar curvature; it produces an excessive anterior pelvic tilt; it causes the thoracic spine to bend in a hyperkyphotic manner; and it causes kyphotic lumbar curvature in the prone position, which often results in intervertebral disc protrusion.

In U.S. Pat. No. 2,861,278 to Young there is disclosed an innerspring mattress which provides only a single convex portion in the lumbar area and ignores all other portions of the body. Young appears to be deficient in many areas in having no hamstring relaxing effect; no superior hip relaxation in the side posture; and only one elevated surface on the device usable beneath the mattress.

In U.S. Pat. No. 3,885,258 to Regan there is a disclosure of a foam rubber mattress of several layers which results in improper support in the lumbar and knee areas. Lack of lumbar support in Regan may, in the prone posture, cause hyperlordosis of lumbar vertebrae (sway back), an unnatural lumbar sacral tilt, and hyperextended lumbar spine. In the supine position flattening of the spine occurs due to the fact that support of the buttocks and the mid-thoracic regions leaves the lumbar region in a hypolordotic unnatural position. In the supine position increased popliteal fossa strain is produced due to support of the calf. In the side position lateral curvature of the spine is likely to occur.

In U.S. Pat. No. 4,207,635 to Leroy there is a disclosure of a sun tanning lounge which purports to support the body in prone and supine positions but which does not provide the proper support in the lumbar and knee areas. Leroy's furniture produces a hypolordosis of the lumbar spine in the supine position; there is no hamstring relaxer; and an increase in kyphotic lumbar curvature is intentionally produced; which is the curvature causing lumbar spine problems. Leroy's support has only a single elevated surface which provides support in the prone position and must be turned over for the supine position, and no provision for use as a side support.

It is an object of this invention to provide an improved contoured support to properly maintain the spine in its natural comfortable curvature. It is another object of this invention to provide such support when the body is in the prone, supine, or side position. A further object is to provide a contoured support for the entire body to reduce and/or inhibit intervertebral disc protrusion and provide therapeutic easing of pain by those suffering from such protrusions, particularly in the lordotic lumbar area. Still other objects will appear from the more detailed description which follows:

BRIEF DESCRIPTION OF THE INVENTION

This invention relates to a contoured body support having an upper surface adapted to conform to a horizontally positioned human body thereon, said support having a head end and a foot end with successive contoured areas therebetween of a thoracic support area, a lumbar support area, a sacral support area, and a knee support area; the head end being at a slightly higher elevation than the foot end, the thoracic area being slightly higher in elevation than the head end, the lumbar area being slightly higher in elevation than the thoracic area, the sacral area being at an elevation between that of the head end and foot end, and the knee area being at an elevation between that of the thoracic area and the lumbar area.

In specific embodiments of this invention the support is an overlayer for a conventional flat top innerspring mattress or waterbed or may be used on the floor with substantially equal efficacy, is made of medium stiffness polyurethane foam, and has two lateral convex ridges, one for the lumbar area, and the other for the knee area.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 1 is a perspective view of the support of this invention;

FIG. 2 is a side elevation view of the support of this invention;

FIG. 3 is a side elevation view of a person in the supine position on the support of this invention;

FIGS. 3A and 3B show enlarged schematic illustrations of the lumbar spinal area when supported in the supine position on a conventional flat top mattress and on the contoured supporting structure of this invention, respectively;

FIG. 4 is a side elevation view of a person in the prone position on the support of this invention;

FIGS. 4A and 4B show an enlarged schematic illustration of the lumbar spinal area when supported in the prone position on a conventional flat top mattress and on the contoured supporting structure of this invention, respectively;

FIG. 5 is a side elevation view of a person in the side resting position on the support of this invention; and FIGS. 5A and 5B show enlarged schematic illustrations of the lumbar spinal area when supported in the side position on a conventional flat top mattress and on the contoured support structure of this invention, respectively.

DETAILED DESCRIPTION OF THE INVENTION

The support structure of this invention is best shown in detail in FIGS. 1 and 2 of the attached drawings in which the support has a head end 10 and a foot end 11 to accommodate, respectively, the head and feet of a person resting horizontally on the mattress. The contoured support may be an overlayer with its bottom surface 28 being substantially planar and resting on top of a conventional mattress 34 or the contoured surface 27 may be the top surface of a one-piece foam mattress 34 or the like which may have a conventional innerspring interior below lower surface 28.

The contoured support structure, especially upper contoured surface 27 is shaped to be complemental to and appropriately fit different portions of the human body. Thoracic portion 12 supports the upper chest and back while the lumbar portion 13 supports the waist and small of the back. Sacral portion 14 provides an effective foundation for the buttocks and lower abdomen, and knee portion 15 supports the knees in a naturally bent position. The head of the person rests on the portion between head end 10 and thoracic portion 12, with or without a pillow as the person desires. Preferably the pillow should be of the type disclosed in U.S. patent application Ser. No. 550,804, filed Nov. 14, 1983 now U.S. Pat. No. 4,550,458 by J. W. Fiore to provide proper support to the nape of the neck, i.e., the seventh vertebra. The feet rest on the portion between foot end 11 and knee portion 15.

Contoured upper surface 27 generally exhibits two convex ridges 35 and 37 extending laterally across the support at the lumbar portion 13 and the knee portion 15, respectively. Between spaced ridges 35 and 37 is a concave depression 36 at the sacral portion 14. These convex ridges 35 and 37 and the concave depression 36 are joined together smoothly in a longitudinal direction 38 to show a curve closely approximating the body outline as seen in FIG. 2. In the lateral direction 39 there are no contours, surface 27 being the same elevation above lower surface 28 at substantially every location along a single lateral line of direction 39 which extends laterally of the longitudinal axis between the ends 10 and 11.

The contour of surface 27 is best seen in FIG. 2 where dimensional measurements are given to locate the curve of upper surface 27. Lower surface 28 is flat with various locations on upper surface 27 being measured as elevations above lower surface 28. A pad which is used to overlay a conventional mattress may have any desired thickness, but it is believed to be necessary to have at least one inch of thickness for the thinnest section at foot end 11 if the same is to be used as a pad on the floor or other hard surface. For a pad one inch thick at foot end 11 the thicknesses at the various locations are as follows:

| | |
|---|---|
| 16 - Head end 10 | 3 inches |
| 17 - Thoracic portion 12 | 3 inches |
| 18 - Lumbar portion 13 | 4 inches |
| 19 - Sacral portion 14 | 2½ inches |
| 20 - Knee portion 15 | 3½ inches |

-continued

| | |
|---|---|
| 21 - Foot end 11 | 1 inch |

The longitudinal location of the contoured portions are conveniently measured from the head end 10 for a total length of 74 inches, which is conventional for mattresses. The distances are as follows:

| | |
|---|---|
| 22 - Head end 10 to thoracic portion 12 | 14 inches |
| 23 - Head end 10 to lumbar portion 13 | 28½ inches |
| 24 - Head end 10 to sacral portion 14 | 35 inches |
| 25 - Head end 10 to knee portion 15 | 50 inches |
| 26 - Head end 10 to foot end 11 | 74 inches |

In FIGS. 3, 4, and 5 there is shown a person 30 lying on the support structure 29 of this invention with or without a pillow 31 for the head. The spine 32 and the sacrum 33 are shown as they would appear if the person 30 is in the supine position (FIG. 3), the prone position (FIG. 4), or the side resting position (FIG. 5). Enlarged views of the spine are shown in FIGS. 3A–5A and 3B–5B. In each instance the A view shows the spine when lying on a conventional flat top mattress and the B view shows the spine lying on the contoured support of this invention.

In the supine or back lying position of FIG. 3 the contoured mattress 29 is the same thickness of 3" from the head end 10 to thoracic portion 12 and then gradually elevates to 4" at the lumbar portion 13. This gradual incline is of major importance to the biomechanics of the spine. The incline follows the thoraco-lumbar contour of the body from approximately the seventh thoracic vertebra to the fifth lumbar vertebra by giving more posterior to anterior support as the curve follows the body toward the lower regions. This provides an anterior pressure to the intervertebral discs reducing the disc's tendency to bulge in a posterior-lateral direction. The posterior-lateral bulging is due to many factors, although, a major contribution is the natural anatomical weakness of the posterior-lateral annular fibers of the intervertebral disc. This weakness allows the nucleus pulposis (the liquid gel-like material which provides a fulcrum on which vertebrae flex, extend, laterally flex, and rotate) to bulge through in a posterior-lateral direction. If the bulge is severe, it will cause compression of the nerve root or neural cord, leading to neurological involvement. Continuing down the spine, the sacral portion 14 allows the sacrum and pelvic area to remain in the proper position. This occurs by having the sacral concave support portion 14 to be 1½" lower than the lumbar convex support portion 13. The desired curvature of the lumbo-sacral area is properly supported in this way so as to prevent flattening of the lumbar spine which normally occurs when sleeping on a conventional flat mattress. Farther down the support structure elevates to a convex ridge 3½" in elevation where the popliteal fossa is located on the average person. This supportive area reduces the tendency for the hamstring muscle group to become tight as is experienced with conventional mattresses. The mattress then curves downward to 1" thickness to allow relaxation of the Achilles' tendon.

In FIGS. 3A and 3B there are shown views of the lumbo-sacral area of the spine in the supine position. In FIG. 3A the view represents the spine when lying on a conventional flat mattress and in FIG. 3B the view represents the spine when lying on the contoured support of this invention. In FIG. 3A it can be seen that sacrum 33 does not have the proper tilt. The natural curvature of the last five vertebrae is not present and is flattened to an unnatural position. This causes compression of one or more nerve roots 40 and posteriorly displaced vertebrae with bulging discs 41. In contrast the view of FIG. 3B shows a proper tilt to sacrum 33 with a natural curvature to the last five vertebrae. No nerve root compression or bulging discs are seen with the proper support in the lumbo-sacral area.

In the prone position as shown in FIG. 4 the lumbar lordosis convex support 13 provides a pressure on the lower abdomen while the sleeper is face down on the mattress. This pressure prevents the lumbar spine from sagging down towards the support structure which causes a hyperlordic or sway back spine. This sway back curvature of the lower back is not desirable because it may result in facet encroachment of imbrication which causes spinal irritation and pain. The lumbar spine is thus provided with a foundation, reducing the facet imbrication which ordinarily can take place within the body in a prone position on a conventional mattress.

In FIGS. 4A and 4B there are shown views of the lumbo-sacral area of the spine in the prone position. In FIG. 4A the view represents the spine when lying on a conventional flat mattress and in FIG. 4B the view represents the spine when lying on the contoured support of this invention. In FIG. 4A it can be seen that the spine has an exaggerated curvature which is known as hyperlordotic lumbar curvature or commonly called "sway back". This curvature causes facet imbrication or encroachment 42 that can be painful. Furthermore, nerve roots 40 can be compressed and irritated providing another source of pain. To the contrary, FIG. 4B shows the spine with its natural lumbar curvature which produces no facet imbrication or nerve root compression.

In the side resting position as shown in FIG. 5 the proper support for the spine is also established. The thoraco-lumbar inclined support between portions 12 and 13 elevates the lateral thoraco-lumbar area which is usually in a sagging or nonelevated position when resting in the side posture position on a conventional mattress. The lumbar support 13 along with the sacral support 14 allows for proper pressure to be applied medially to maintain intervertebral disc integrity and alignment. This is achieved by preventing lateral flexion of the spine normally occuring with a conventional mattress. By preventing lateral flexion in the spine the posterior-lateral disc bluge is supported. This support reduces nerve root or neural cord compression due to the disc bulging mechanism and vertebral subluxation complex (minor dislocation of the vertebrae). Lower on mattress 29 it may be seen that the hamstring support 15 serves to support the lateral-aspect of the inferior knee reducing ligament and muscular tension of the superiorly positioned hip and upper leg.

In FIGS. 5A and 5B there are shown views of the spine from the thoraco-lumbar portion 43 to the sacrum 33 in the side resting position. In FIG. 5A the view represents the spine when lying on a conventional flat mattress. In FIG. 5B the view represents the spine when lying on the contoured support of this invention. In FIG. 5A it can be seen that the lumbar portion 44 of the spine is curved laterally with sacrum 33 tilted laterally causing compression of nerve roots 40 on the concave side of the spine and laterally displaced bulging discs 41 on the convex side of the spine. In FIG. 5 it can be seen that lumbar portion 13 of the sacral portion 14 of the contoured support of this invention support the waist and buttocks in such a position that the spine is straight. In this position there are no compressed nerve roots or bulging discs.

Since the body is not a flat structure, a flat mattress induces various stresses on the musculoskeletal and ligamentous system. In the supine or back lying position a regular mattress or waterbed causes a flattening of the normal lordotic cruve of the lumbar spine, while placing excess pressure on the lower pelvic area and lower sacral area. This produces a structural deviation which causes intervertebral discs to bulge outwardly to cause nervous system interruption and irritation. The intervertebral discs between L4 and L5 and also between L5 and S1, are the most commonly herniated discs in the lumbar spine. These are specifically supported by the contoured mattress of this invention to cause the spine to assume the normal lordotic lumbar curve, reducing the potential for lumbar disc protrusion. Being based upon a sound biomechanical hypothesis the support structure of this invention can materially contribute to the health of many people by reducing back strain and pain and even inhibiting bulging discs initially or substantially retarding previous disc bulges and helping to prevent intervertebral disc bulging of normal discs.

The preferred material of construction is a medium stiff polyurethane foam readily available commercially and commonly used in pillows and foam mattresses.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A contoured body supporting mattress comprising a unitary resilient body of material having an upper surface and a lower flat surface, said upper surface being adapted to support a horizontally positioned human body thereon, said mattress being free of any large irregular valleys or openings which would interfere with proper spinal support by said mattress of a human body positioned thereon in prone, supine and side posture positions, said mattress being elongated and having a head end portion and a foot end portion with successive contoured areas therebetween of a thoracic support area for supporting an upper chest and back, a lumbar support area for supporting a waist and small of a back, a sacral support area for supporting a buttocks and lower abdomen, and a knee support area for supporting knees of legs; said head end portion being slightly vertically thicker in height than said foot end portion, said thoracic area being substantially the same thickness as said head end portion, said lumbar area being slightly vertically thicker than said thoracic area, said sacral area having a thickness between that of said head end portion and said foot end portion, and said knee area having a thickness between that of said thoracic area and said lumbar area.

2. The mattress of claim 1 wherein said contoured areas change in thickness in the longitudinal direction from said head end portion to said foot end portion, and do not change in the lateral direction at right angles to said longitudinal direction.

3. The mattress of claim 1 which is a relatively thin layer of foamed elastomeric material adapted to be an overlayer to be placed on top of a conventional noncontoured mattress.

4. The mattress of claim 1 wherein the respective differences in thickness above said foot end portion are:
head end portion—2 inches
thoracic area—2 inches
lumbar area—3 inches
sacral area—1½ inches
knee area—2½ inches.

5. The mattress of claim 4 which is 74 inches long from said head end portion to said foot end portion and wherein the distances from said head end portion to the center of contoured areas are:
thoracic area—14 inches
lumbar area—28½ inches
sacral area—35 inches
knee area—50 inches.

6. The mattress of claim 1 which is 74 inches long from said head end portion to said foot endportion and wherein the distances from said head end portion to the center of contoured areas are:
thoracic area—14 inches
lumbar area—28½ inches
sacral area—35 inches
knee area—50 inches.

7. A contoured body supporting mattress comprising a unitary resilient body of material having a head end portion and foot end portion defining a longitudinal direction therebetween and two side portions defining a lateral direction therebetween; said mattress being free of any large irregular valleys or openings which would interfere with proper spinal support by said mattress of a human body positioned thereon in prone, supine and side posture positions, said mattress having a lower flat surface and an upper surface being contoured in said longitudinal direction by laterally extending concave depressions and convex ridges to produce a contour holding a spine of one resting in a supine position on said mattress in its natural curvature, said contours including a thoracic portion for supporting an upper chest and back, and a lumbar portion for supporting a waist and small of a back, a sacral portion for supporting a buttocks and a lower abdomen, and a knee portion for support knees of legs; said thoracic portion being substantially flat adjacent said head end portion and extending up an inclined surface to said lumbar portion which is defined by a ridge approximately one inch vertically thicker in height than said head end portion; said sacral portion being defined by a depression approximately one-half inch vertically thinner than said head end portion and being adjacent the lumbar portion toward said foot end portion; said knee portion being a ridge approximately one-half inch vertically thicker than said head end portion and being located generally medially between said sacral portion and said foot end portion.

8. The mattress of claim 7 which is made of polyurethane foam of a medium stiffness.

9. The mattress of claim 7 which is the top portion of a conventional mattress.

10. The mattress of claim 7 which is a separate overlayer to be placed on top of a conventional spring mattress.

11. An elongated and contoured body supporting structure comprising a unitary resilient body of material and having a flat surface and an upper undulating surface adapted to support a horizontally positioned human body in prone, supine and side posture positions, said structure having a longitudinal axis and a head end portion spaced from a foot end portion with successive contoured portions therebetween of a thoracic support portion, a lumbar support portion, a sacral support portion, and a knee support portion, said structure being free of any large irregular valleys or openings which would interfere with proper spinal support by said structure of a human body positioned thereon in any of the prone, supine or side posture positions, said head end portion being slightly vertically thicker than said foot end portion, said thoracic portion having the same thickness as said head end portion, said lumbar portion being slightly vertically thicker than said thoracic portion, said sacral portion having a thickness between that of said head and foot end portions, and said knee portion having a thickness between that of said thoracic and lumbar portions, all of said body supporting portions extending laterally on either side of said longitudinal axis and being substantially uniform in respective thicknesses from side to side of said structure.

12. The structure of claim 11 wherein said flat bottom surface is adapted to be positioned on a conventional mattress or on a floor or the like.

13. The structure of claim 11 wherein said contoured portions are smoothly interconnected by transitional portions with changes in thickness in the direction of said longitudinal axis from said head end portion to said foot end portion, and without any substantial change in the lateral direction at right angles to said longitudinal axis.

14. The structure of claim 11 which is defined by a layer of foamed elastomeric material having a thickness of not more than about 4 inches.

15. The structure of claim 11 wherein the respective differences in the greatest thickness above the foot end portion are:
head end portion—2 inches
thoracic portion—2 inches
lumbar portion—3 inches
sacral portion—1½ inches
kness portion—2½ inches.

16. The structure of claim 11 which is 74 inches long between said head end and foot end portions and wherein the distances from said head end portion to the lateral center of said contoured portions are:
thoracic portion—14 inches
lumbar portion—28½ inches
sacral portion—35 inches
knee portion—50 inches.

17. An elongated contoured support structure comprising a unitary resilient body of material having a flat lower surface, a head and foot portion including respective end edges, a longitudinal axis therebetween with a pair of spaced side edges parallel to said longitudinal axis and defining the lateral direction therebetween; said structure being free of any large irregular valleys or openings which would interfere with proper spinal support by said structure of a human body positioned thereon, said structure having smooth interconnecting contours along said longitudinal axis by laterally extending concave depressions and convex protrusions between said side edges to define an undulating upper support surface for maintaining the spine of one resting in the prone and supine posture position on said upper surface in its natural curvature and the spine in alignment as viewed from the side in the side posture positions, said contours including a thoracic portion, a lumbar portion, a sacral portion, and a knee portion; said thoracic portion being substantially the same thickness in height as said head portion and extending up an inclined surface to said lumbar portion which is defined by a protrusion approximately one inch vertically thicker than said head end portion; said sacral portion being defined by a depression approximately one-half inch vertically thinner than said head end portion and being adjacent said lumbar portion toward said foot end portion; said knee portion being defined by another protrusion approximately one-half inch vertically thicker than said head end portion and being located medially between said lumbar portion and said foot end portion; and said foot end portion being the lower end of an inclined surface sloping downwardly from said knee portion.

18. The structure of claim 17 which is defined by a layer of foamed material of a medium stiffness to provide support for a spine of a human body.

19. The structure of claim 17 wherein said lower surface is substantially rectangular, said structure having spaced side and end walls extending generally vertically and intersecting said upper support surface at respective said side edges and said end edges.

20. The mattress of claim 17 wherein the respective differences in thickness above said foot end portion are:

head end portion—2 inches
thoracic area—2 inches
lumbar area—3 inches
sacral area—1½ inches
knee area—2½ inches.

* * * * *